US007963790B1

(12) United States Patent
Winter, Jr.

(10) Patent No.: US 7,963,790 B1
(45) Date of Patent: Jun. 21, 2011

(54) PIVOTING CONNECTOR

(76) Inventor: John T. Winter, Jr., Bartlett, TN (US)

( * ) Notice: Subject to any disclaimer, the term of this patent is extended or adjusted under 35 U.S.C. 154(b) by 0 days.

(21) Appl. No.: 12/579,508

(22) Filed: Oct. 15, 2009

Related U.S. Application Data

(60) Provisional application No. 61/105,954, filed on Oct. 16, 2008.

(51) Int. Cl.
*H01R 13/625* (2006.01)

(52) U.S. Cl. ..... 439/341; 439/287; 439/357; 439/264

(58) Field of Classification Search ..... 439/372–376, 439/387–411
See application file for complete search history.

(56) References Cited

U.S. PATENT DOCUMENTS 2,093,037 A * 9/1937 Douglas ..... 439/319
3,489,986 A * 1/1970 Frederick ..... 439/264
5,586,898 A * 12/1996 Anderson et al. ..... 439/287
5,639,253 A * 6/1997 Rantanen ..... 439/341
6,089,898 A * 7/2000 Lincoln et al. ..... 439/357
6,155,860 A * 12/2000 Lemke et al. ..... 439/341
6,350,141 B1 * 2/2002 Houtz ..... 439/341
6,422,888 B1 * 7/2002 Goble ..... 439/341
7,255,586 B2 * 8/2007 Okada ..... 439/346

* cited by examiner

*Primary Examiner* — Truc T Nguyen

(74) *Attorney, Agent, or Firm* — Wyatt, Tarrant & Combs, LLP; H. Roy Berkenstock

(57) ABSTRACT

The current invention teaches a new and novel electrical connector which utilizes a cover with complimentary lower curved engagement aids to ensure the accurate engagement and disengagement of a plurality of data and electrical connections. The electrical connector further allows the one-handed engagement and disengagement of the connector while reducing the lateral forces required and reducing the corresponding stress on the conductor wires.

5 Claims, 6 Drawing Sheets

PIVOTING CONNECTOR

CROSS-REFERENCE TO RELATED APPLICATIONS

This application claims priority under 35 USC 119(e) to U.S. Provisional Application No. 61/105,954 entitled "Pivoting Connector", filed Oct. 16, 2008, which is incorporated herein by reference in its entirety.

STATEMENT REGARDING FEDERALLY SPONSORED RESEARCH OR DEVELOPMENT

Not applicable

REFERENCE TO A "MICROFICHE APPENDIX"

Not applicable

FIELD OF THE INVENTION

The present invention generally relates to a plug and receptacle type (male and female components) connector for accurately interconnecting a variety of signals such as electrical or data.

BACKGROUND OF THE INVENTION

The present invention finds particular application in respect of high discharge rate battery circuits as well as applications requiring a secure polarity orientation, resistance against accidental uncoupling, and a capacity for one-handed disconnection. The particular field of connectors in consideration are those utilized to interconnect two electrical leads or cords, as where a battery charger is connected to a battery, or a battery to an operational piece of equipment, including model airplanes, power tools, electric motors and the like, either carrying high currents or high voltage, or both. An additional field of connectors in consideration includes those utilized to interconnect two data transmission cables, as where a data transmission cable is connected to peripheral devices.

Present connectors finding use and popularity in the identified fields are among those known as Deans Connectors, DuraTrax Power Poles, Castle Creations Anderson Power Pole connectors, Sermos Power Poles and Astro Zero Loss connectors. The majority of these connectors are in-line connectors, wherein a pin or plate is inserted into a sleeve of generally matching cross section, in an interference fit. Frequently, the pins and sleeves have ridges, or a spring-loaded interaction on one of the pins or sleeves to ensure a secure fit and connection. The connectors generally provide secure connections, however, they do not necessarily prevent misalignment of specific cables/wires nor prevent the possibility of short circuit or shock.

Prior art counterparts frequently utilize rocker type connectors, frequently of a complementary mirror image construction, herein the respective connectors include cooperative slots and sloped or radiused edges whereby the connectors (conducting portions) are coupled (usually starting at about a 90 degree relation and rotated into an in-line relation) at which they are both mechanically and electrically interlocked. U.S. Pat. Nos. 3,480,903; 2,977,567; 2,738,477; 2,693,585; 2,693,071; 2,626,168; 2,522,672; 2,478,143;1,689,824; and 1,225,127. While providing a secure mechanical and electrical connection, the connectors require extreme care to ensure that cross-polarities and short circuits are not created during connection. Similarly, additional insulators are required such as the slideable sleeve illustrated and described in U.S. Pat. Nos. 2,738,477 (reference number 36) and 2,478,143 (reference number 7).

SUMMARY OF THE INVENTION

The proposed invention comprises a connector that can be used in a plurality of applications including AC and DC current, signal (millivolt) or data transmission, single phase, three-phase, Delta and/or Y Phase, common household current, and simple battery terminal-type connections. As illustrative of only one embodiment of the invention, the small connector described is approximately 0.45 inches×0.56 inches×1 inch, and is designed to capture wires up to 12 gauge in diameter. Notwithstanding, smaller and larger size connectors may be utilized depending on the number of conductors and/or capacity required for a specific application. For higher current draws, the components necessarily increase in size while the converse is also true. The method of termination may also vary to accommodate stranded or solid wire. Furthermore, although the described embodiments consist of two free-hanging connector halves, the connector may be utilized in a configuration where one half is held stationary, such as being restrained and/or mounted on a panel.

The main connector bodies, individually or as a group, are made from a high impact, heat resistant, and non-electrically conductive plastic such as glass-filled polycarbonate, Radel, Rhinite, or any dielectric plastic. These materials allow for the option to easily mass produce the invention via injection molding in addition to serving as electrical insulators. The U-shaped clips, blades, and other component connector parts are made from a metal such as brass, copper, or other gold plated conductor and may be fabricated, machined, or stamped via methods known to those in the art.

To satisfy various user applications, two wire retention methods are presented: a "screw and nut" version, and a "solder" version. The method chosen depends on both the application as well as user preference. For quick wire termination, the screw and nut version is preferred. When maximum current capacity and/or a more permanent connection is desired, the solder tab is preferred.

The unique mechanism for alignment and final assembly, designed into the main connector bodies, ensures correct polarization every time. While some embodiments are designed for snap assembly of the blades and clips into their respective housings, other embodiments may utilize a complimentary blade configuration to reduce the overall size of the connector and allow for a plurality of conductors on the same connecting block. Furthermore, with the screw and nut wire retention method, the screws may be utilized as cross-beam posts which prevent pull out of the metal contacts from the plastic housings.

The connector halves are defined as one "male" and one "female." Like many electrical connectors, the male connector includes the blade(s) and the female connector is commonly comprised of a U-shaped clip to receive the blade, but may also be comprised of a complimentary blade. Both the male and the female connectors are designed to fit together only one way and provide correct polarization for a variety of connections. Furthermore, the outer non-conductive bodies of the connectors ensure that contacts will not approach each other until and unless the connector halves have been properly aligned and rotated into position. This ensures safety in engaging the connector.

The two connector halves assemble together easily starting with both halves positioned approximately 90 degrees to each other. For initial alignment, fin & slot features are located on the lower curled portion of each connector housing so that the halves cannot be misaligned prior to electrical contact. These complimentary structures are found on both the female and males connectors and provide for effortless "self centering" when the two connector housing structures are brought into close proximity to one another. Both connector halves have been designed with interlocking capture features at the base. The lower curled portion of each connector resembles a partial spiral, one spiral per half, and creates a coupling effect so that early on in the alignment and assembly of both halves—the first 30 degrees of rotation—they provide sufficient guidance of the two halves through the beginning of rotation assembly.

Anywhere along the initial 30 degrees of rotation, disassembly is rather easy by simply separating the two connector halves. The function of the spirals at this point in the assembly rotation is to gently guide the two halves to the next phase. As the two halves are brought closer together in their assembly rotation—the 30 to 60 degrees of rotation—the spirals tighten and provide the accuracy and strength necessary for initial connector alignment and assembly. At this point of rotation not only does disassembly require de-rotation, the two halves are in proper alignment to allow for simultaneous engagement. As the two halves are brought to the final assembled position—the final 30 degrees of rotation—the spirals now provide accurate alignment and "snap-fit" positioning. At final assembly, both the external radius on the one spiral and the internal radius of the other spiral are now coaxial and in contact with one another. This unique form of connector assembly enables the connector to be connected/disconnected with or without current applied. If assembly commences with current applied, electrical arcing (sparking) is minimized thus minimizing damage (corrosion/pitting) to the contacts. Compared to other connector designs (Deans, Molex), this connector contains no sharp edges to hang and prevent safe, effective, and immediate electrical contact. This connector design consistently allows for safe, immediate, and effective contact on the first attempt.

Another prominent feature, and one that sets the current invention apart from the competitive market, is the ability for the connector assembly to be connected and disconnected using just one hand. Most electrical connectors in use today engage and disengage laterally and require a large amount of opposing lateral force which can lead to a sudden release and ensuing injury to both the user and equipment. Some examples of common injuries would include cut wrists, banged knuckles, damage to other wiring in confined spaces, and/or electrical shock. A tremendous advantage of the pivoting connector is the elimination of these types of injury or damage. Furthermore this easy disengagement characteristic reduced the lateral force needed to disengage the connectors and the corresponding strain on the wires as a result of such. By reducing this stress on the wires, the possibility of bare or exposed electrical wires is minimized or eliminated and the useful life of the device is extended.

The "snap" lock engagement of the current invention also allows the two halves to be disengaged by simply prying the thumb on the underside of the assembly while simultaneously pressing down the two halves with two fingers. Once the initial resistance is overcome, the two halves will naturally continue to separate along the arc until the two halves separate easily and completely. Most important though, electrical contact will be severed completely and simultaneously across the connector approximately 60 degrees into the de-rotation arc. The benefits of this are easily recognized. This invention permits one the ability to repeatably connect and disconnect on the first attempt. Successful first attempt connections minimize damage to any connector and attached electrical devices. Similarly, disconnection of the power source from the electrical device is simultaneous, instantaneous, and complete. With the ever increasing use of Lithium batteries, or any high discharge storage device and/or power supplies, a positive engagement is more important than ever. One example of an application for this invention is as a replacement for current battery connections for model airplanes. Current state of the art connectors, such as the Deans connector, require two hands and the lateral force required to disengage the connector risks injury to the model airplane. In addition, due to multiple plugs/unplugs, these connectors simply wear out and are the cause of electrical fires/explosions, and the like. Furthermore, mishandled connects/disconnects have resulted in injury to both humans and model planes alike. The ability to safely reach in with only one hand (the other hand still holding onto the plane), and disconnect the power source to a fast moving propeller motor, as with the current invention, represents a appreciable advantage over existing connector styles.

Another advantage of the current invention is that there are no special tools required to attach a wire to the connector. No hand crimpers, no leverage type devices, leverage increasing devices, or hydraulic powered crimpers are required. Simple tools such as screwdrivers and/or hex wrenches are required for proper, complete, and safe attachment. Any method of wire stripping is suitable as long as the wire is not damaged. Additionally, the invention is effective in preventing accidental disconnects, particularly in critical applications. The necessity for disengagement by de-rotating the connector 90 degrees prevents accidental "pull-out" type disconnects.

Other applications involve any serviceable equipment or appliance which requires disconnecting wires in tight confines. Examples of such applications would include all major home appliances such as water heaters, washers, dryers, and heating & air conditioning systems. The ability to easily and safely disconnect wires in confined spaces using just one hand is a major advantage over current methods. Automotive and Aerospace are two other industries which use a variety of connector styles, sizes, and shapes. Popular connector brands such as Molex, AMP, Anderson Powerpole, and Sermos, or styles such as crimp, spade, or butt connectors, are widely used in these industries. These connectors often require disconnection in tightly confined spaces. In many instances, the connectors are meant as "permanent" connectors, yet disassembly for maintenance or repair is still necessary. Often the result of disconnecting those state of the art connectors is a broken connector. This connector solves these problems, offering the added superior benefits of secure, low maintenance, and safe connections.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
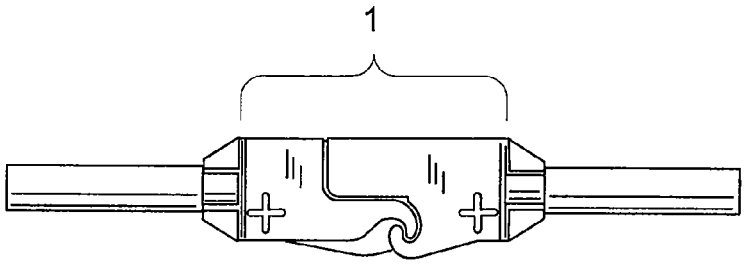
FIG. 1 is a side plan view of an embodiment of the present invention.
Figure 2:
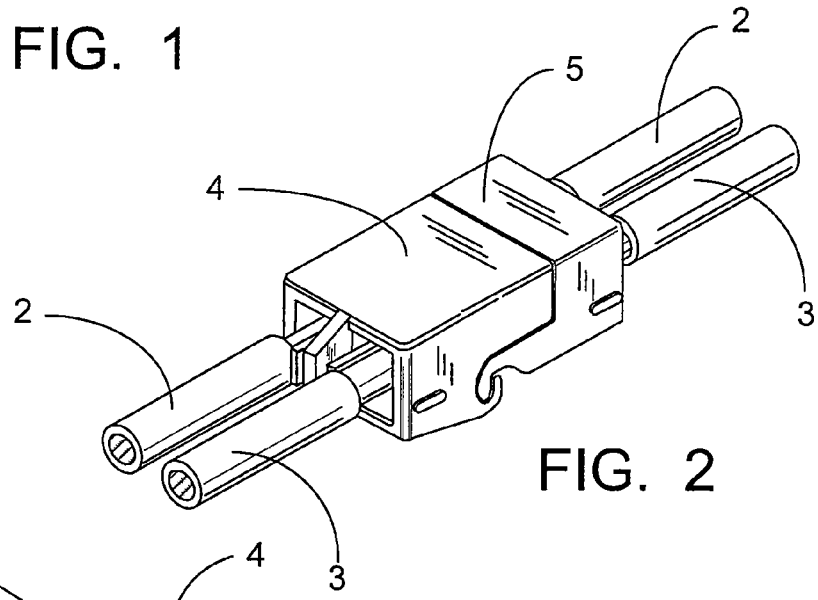
FIG. 2 is a perspective top view of FIG. 1.
Figure 3:
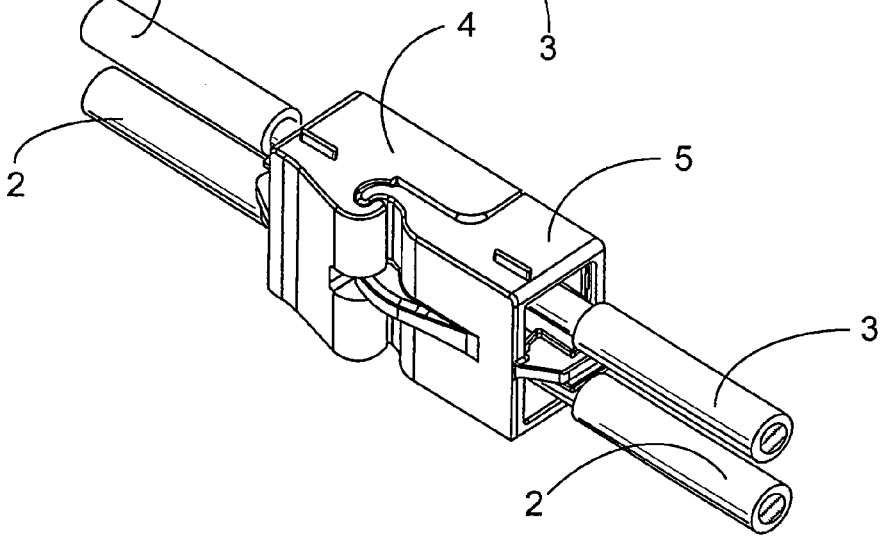
FIG. 3 is a perspective bottom view of FIG. 1.
Figure 4:
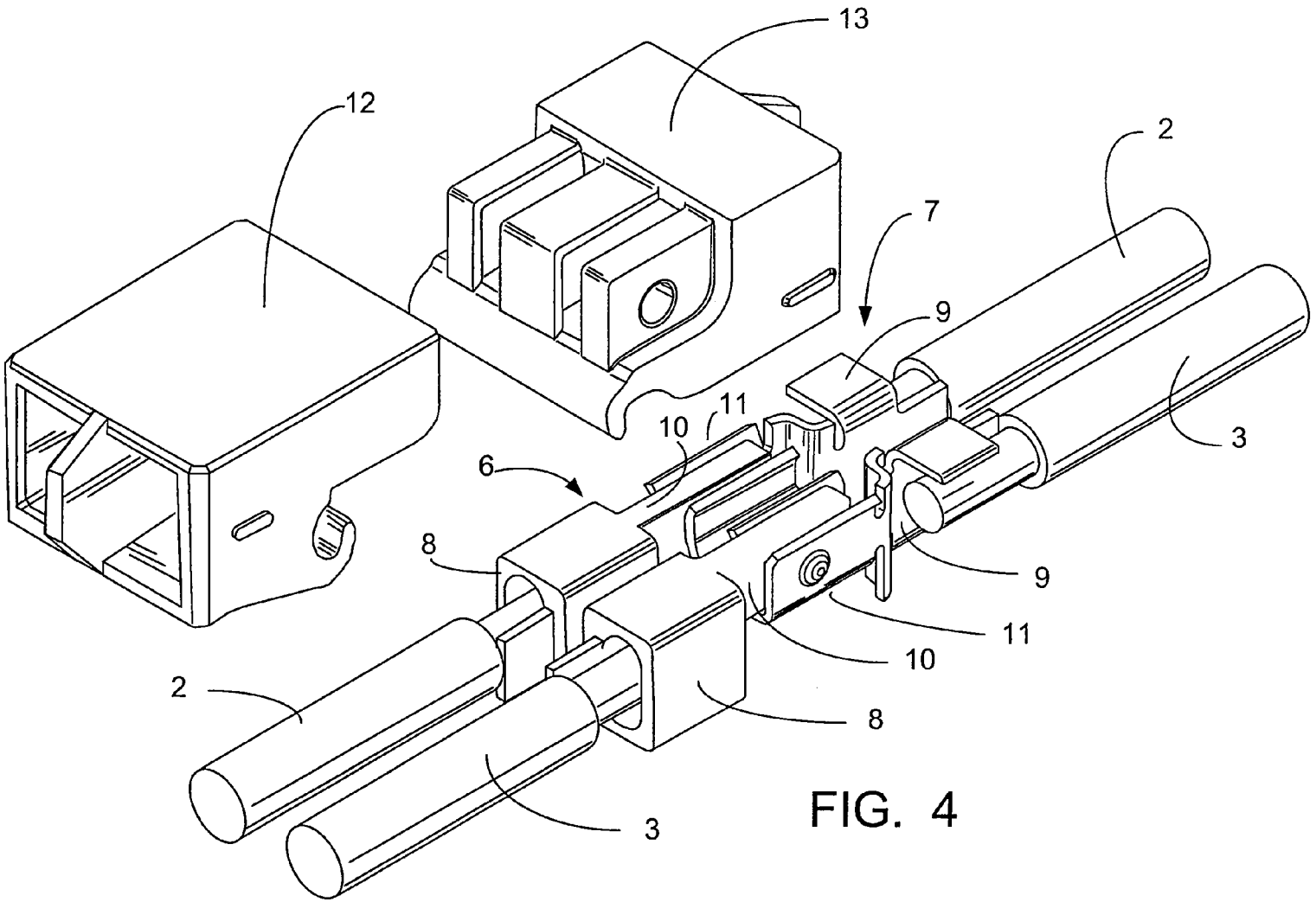
FIG. 4 is a schematic drawing of FIG. 1 with protective covers broken away.
Figure 5:
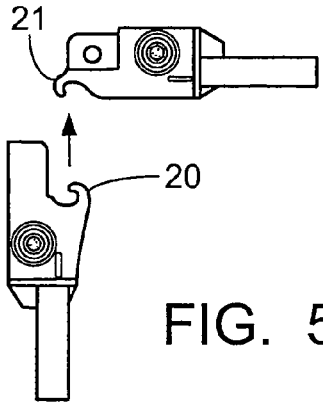
FIGS. 5-8 represent a plan view of FIG. 1 in various stages of engagement.

FIGS. 1-4 describe a first embodiment of the invention comprising an inventive connector 1 further comprising a first end 4 and a second end 5. The first end 4 further comprises an individual plug connector 6 and outer cover 12 and is commonly referred to by those skilled in the art as the male connector. The male plug connector 6 is constructed of a metal such as brass, copper, or other conductive material as known to those skilled in the art and may be fabricated, machined, or stamped. These metal components may also be gold plated, as is the standard for the highest quality connectors known in the art. The male plug connector 6 further comprises a conductor receiving trough 8 and a blade 10 extending therefrom and used to transmit a signal across the span of the connector. The positive and negative conductors 2 and 3 are affixed to the interior cavity of the conductor receiving trough 8 by soldering or welding or some other method of providing secure physical and electrical connection which may be known to those skilled in the art.

The second end 5 of the connector further comprises an individual plug connector 7 and outer cover 13 and is commonly referred to as the female connector by those skilled in the art. The female plug connector 7 is similarly constructed of material and in a method similar to the male connector. The female plug connector 7 is further comprised of conductor receiving troughs 9 similar to those found on the male connector, but which are integrally connected to a U-shaped clip 11, capable of receiving the blade 10 extending from the male plug connector 6. Similar to the male plug connector 6, positive and negative conductors 2 and 3 are affixed to the interior cavity of the receiving trough 9 by soldering, welding, or some other method of providing secure physical and electrical connection which may be known in the art of affixing the connectors 2 and 3 to the interior cavity of the trough 9.

Figure 11:
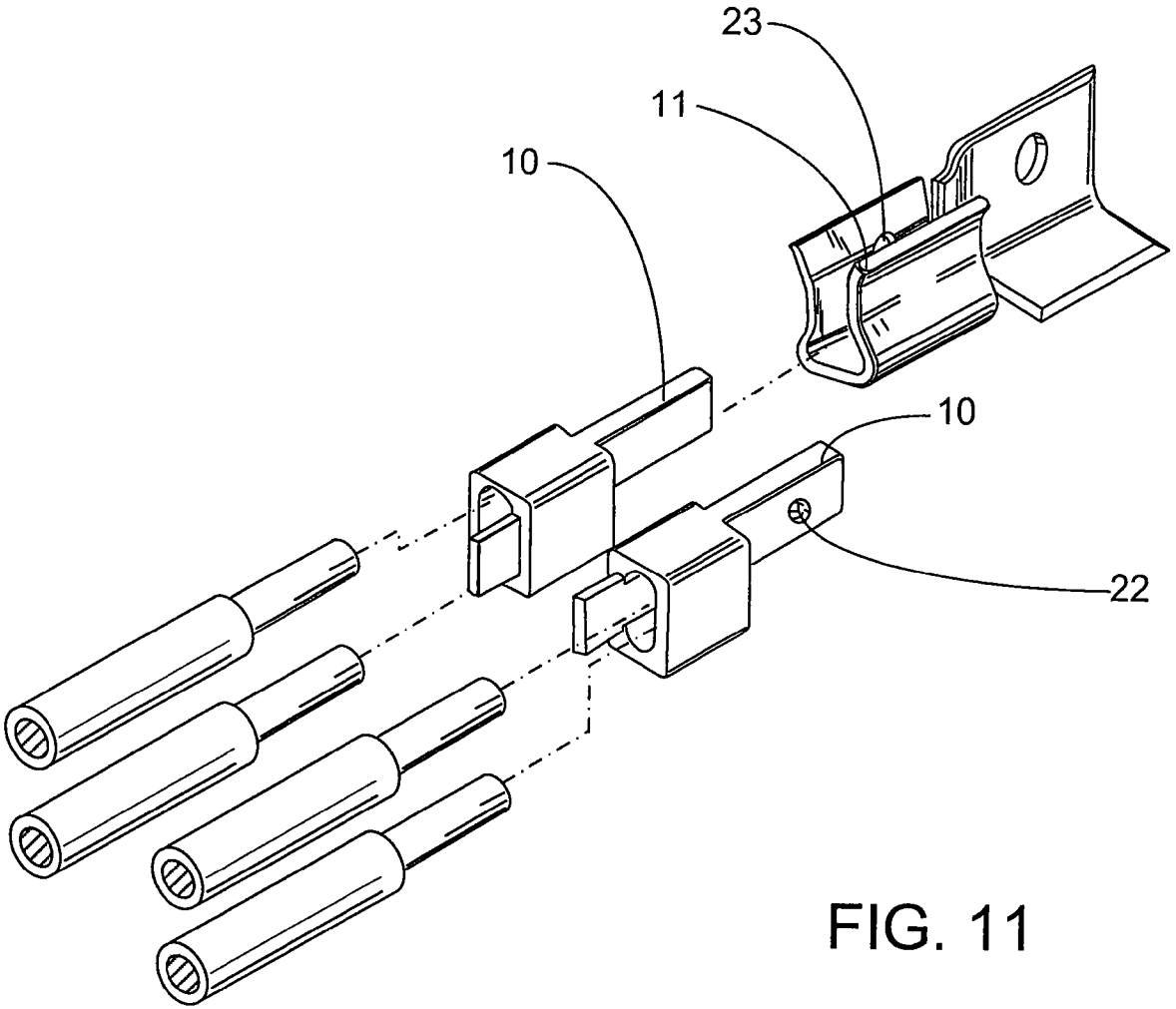
FIG. 11 is a perspective top view of FIG. 1 with protective covers broken away and connectors disengaged.

The blade 10 and U-shaped clip 11 structures of the connector 1 are designed to engage with a slight friction fit method as known in the art, for optimum surface contact area at assembly. The receiving span of the U-shaped clip 11 is undersized by approximately 0.003 inches from the width of the complimentary blade 10 structure, creating a natural "horseshoe shaped" spring across the receiving span of the U-shaped clip 11, which when forced apart by the insertion of the blade 10, maintains constant force on the outer walls of the blade 10 and prevents accidental disengagement while maximizing surface area contact between the complimentary connectors. The friction fit is further aided by the presence of complimentary structures on the blade 10 and U-shaped clip 11 meant to further prevent accidental disengagement and illustrated in FIG. 11. The blade 10 shaped structure comprises a cylindrical raised detent 22 located distal to the conductors 2, 3 and in a position meant to engage with a similar cylindrical detent 23 located on the U-shaped clip 11. Upon full engagement of the connectors 2, 3 this "over the center" style locking feature prevents unintended disengagement of the connectors by providing sufficient resistance requirements for disengagement. Larger connector sizes may encompass additional use of the illustrated method or may encompass additional external locking mechanisms to prevent unintended disengagement.

Figure 12:
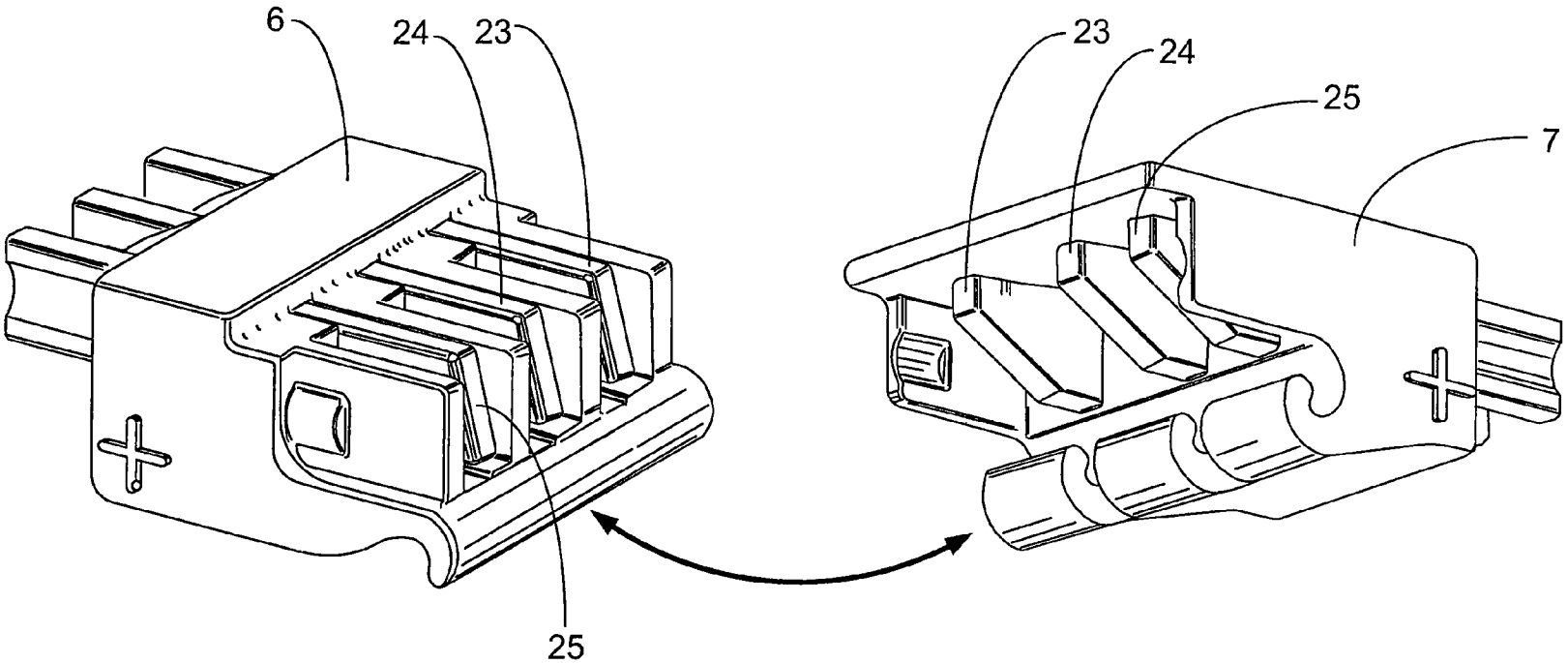
FIG. 12 is a perspective top view of an alternate embodiment of the invention with protective covers removed.

As illustrated in FIG. 12, an alternate embodiment of the invention may utilize two complimentary blades 24, 25 in lieu of the blade 10 and clip 11 configuration in order to provide for a more compact connector. Unlike the blade 10 and clip 11 configuration already described, this complimentary blade embodiment of the invention does not utilize friction to maintain contact between the complimentary connectors 24, 25. Instead, this embodiment utilizes extremely tight tolerances to ensure the proximate placement of the complimentary blades 24, 25 in order to ensure surface to surface contact. Additionally, the ends of both complimentary blades 24, 25 are beveled which allows for electrical contact and engagement at a specific position in the engagement cycle of the connectors as described below.

The outer covers 12, 13 encasing both the male and female connectors 6, 7 provide a fully insulated engagement locking mechanism when assembled. These outer covers 12, 13 insulate and enclose the connectors 6, 7 and provide a distinct advantage over prior electrical connectors. Foremost, the outer covers 12, 13 provide a reliable and repeatable mechanism for securely presenting the connectors 6, 7. Additionally, the outer covers 12, 13 ensure the correct polarity of the connection by allowing the connectors 6, 7 to be presented and engaged in only one manner as prescribed by the design of the outer covers 12, 13. Furthermore, these outer covers 12, 13 may be assembled over connectors 6, 7 or molded thereover, as is known in the art. The covers 12, 13 may be constructed of a high impact, heat resistant, and non-electrically conductive plastic such as glass-filled polycarbonate, Radel, Rhinite, or any dielectric plastic. These materials serve as electrical insulators while providing the option for mass production via injection molding practices generally known in the art.

The small connectors 6, 7 described and illustrated may be about 0.25 inches by 0.5 inches by one inch, which is suitable for accommodating wire sizes up to 12 gauge. Smaller and larger sizes of the inventive connector may be made, depending on the number of conductors desired and/or electrical capacity required for the application. For higher current draws, the components normally may be expected to increase in size.

Figure 10:
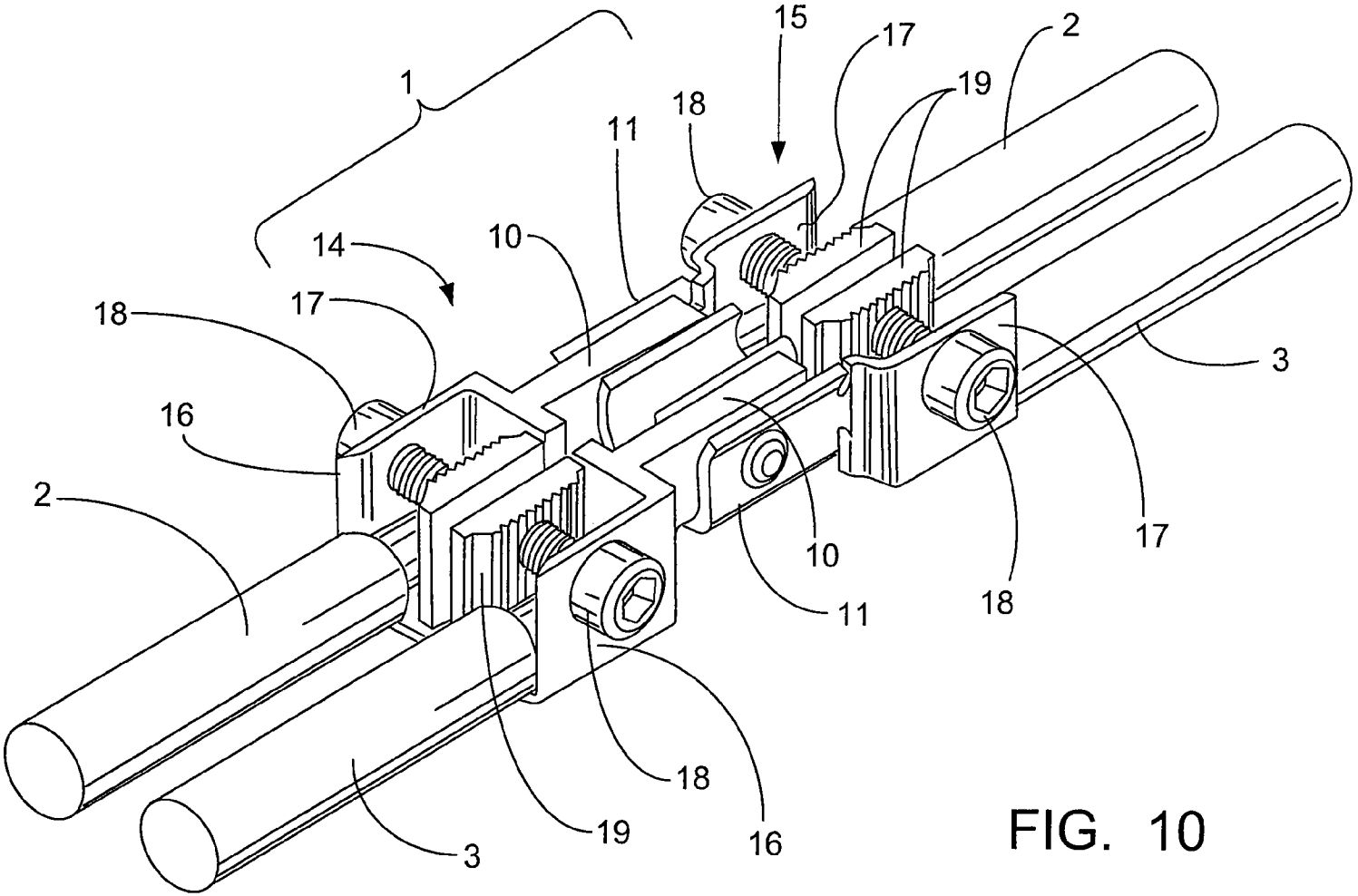
FIG. 10 is a schematic drawing of FIG. 9 with protective covers removed.

Types of termination of a conductor within a trough 8, 9 may vary to accommodate stranded or solid wire, and solder or screw and nut embodiments. Referring to FIG. 10, a second embodiment of the invention utilizes a screw and net method of affixing the conductors 2, 3 to the interior cavity of the receiving trough 9 and provides a secure physical and electrical connection restraining the conductors 2, 3. Conductors 2 and 3 are clamped into troughs 16, 17 via a set of screws 18 situated opposite a set of draw plates 19 whereby by tightening screw 18, the bared end of the conductor 2, 3 is firmly captured for a secure physical and electrical contact. The illustrated connectors 14, 15, like those of the first embodiment 8, 9, are enclosed in covers 12, 13 to provide a fully insulated plug 1 when assembled. Covers 12, 13 may be assembled over connectors 8, 9, 14, 15 or molded thereover.

Even though the presently described embodiments comprise two free-hanging connector halves 4, 5, the connector includes an embodiment wherein one half may be held stationary, such as being restrained and/or mounted in a panel, electrical box, or the like. In addition, multiple connector bodies may be combined and mounted. This sort of embodiment offers the option of providing a single large multiple connector body or several separate connector bodies, providing parallel conductors.

Figure 6:
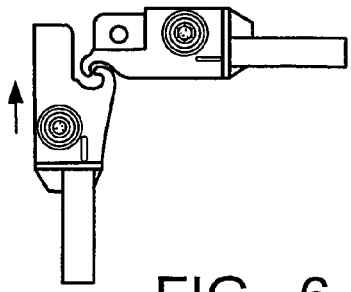

All embodiments represent a unique mechanism for alignment and final assembly as illustrated by FIGS. 5-9. Said mechanism is similar for all embodiments of the invention and ensures correct polarization and repeated engagement of the connector. For illustrative purposes, reference will be made to the structure of the first embodiment, however, the unique mechanism for alignment and engagement of the connector shall be regarded as common to all embodiments of the invention. The connector half referred to as the "male" connector 6 in FIGS. 4 and 12, comprises a blade 10, 24 which engages with the "female" connector 7, which comprises a U-shaped clip 11 or a complimentary blade 25. The process of engaging the connector is first illustrated in FIG. 5 as the "male" connector 6 is perpendicularly aligned with the "female" connector 7 in a manner oriented such as to allow the curved lower engagement end 20 of the "male" connector 6 to align with a complimentary curved lower engagement end 21 of the "female" connector 7. Following initial presentation and proper orientation, two connector halves 6 and 7 will be aligned perpendicular to each other as illustrated by FIG. 6. For initial alignment, the curved lower engagement end 20 of the male connector 6 comprises a fin and slot relief feature meant to align with a complimentary feature on the curved lower engagement end 22 of the female connector 7, to allow for the guided presentment and engagement of the two connectors 6 and 7 when brought in close proximity, prior to engagement, as illustrated by FIG. 6.

Figure 7:
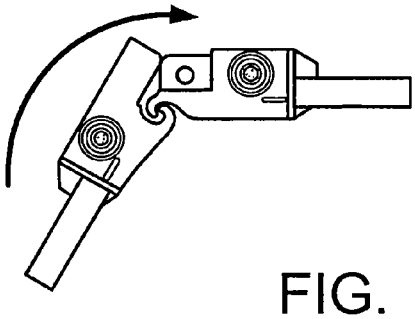
Figure 8:
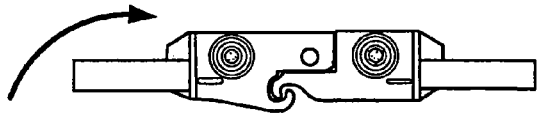
Figure 9:
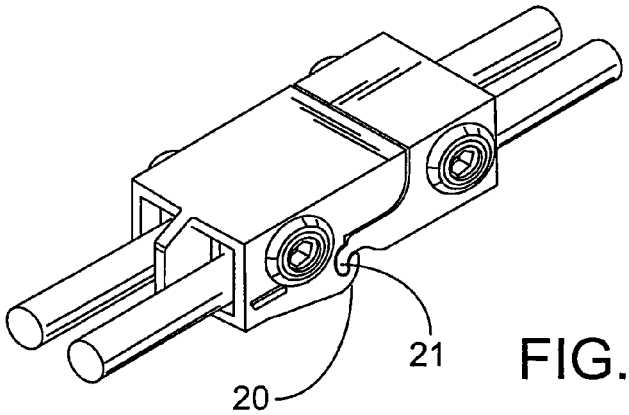
FIG. 9 is a perspective top view of an alternate embodiment of the present invention.

Following initial presentment and upon initial rotation of the engagement connector as illustrated in FIG. 7, the curved lower engagement ends 20 and 21 of the male 6 and female 7 connectors engage and provide sufficient guidance of the two connector halves to properly align the complimentary structure 11, 25 with the corresponding blade 10 for presentment and engagement. Once past the point of 60 degrees rotation, the curved lower engagement ends 20, 21 of the complimentary connectors 6, 7 engage in a matter which prevents disengagement without de-rotating the connectors 6, 7. Upon final rotation of the connectors 6, 7 as illustrated in FIGS. 8 and 9, the complimentary connection is completed and the blade structure 10 of the first connector 6 engages the U-shaped clip 11 or complimentary blade 25 of the second connector at which point the external radius of the first curved lower engagement end 20 and the internal radius of the second curved lower engagement end 21 are now coaxial and engaged.

The embodiments shown and the procedures set forth above are intended to simply be illustrative and are not intended to limit the scope of this invention, it being intended that all equivalents thereof be included in the scope of the appended claims.

What is claimed is:

1. An in-line electrical connector for joining conductors composed of two or more conducting wires comprising:

a pair of conductor end housings, one for terminating an end of each of the conductors to be connected; and the first of said end housings including an isolated blade termination trough for each associated conducting wire of said conductor, the blade of such trough extending forwardly of the line of each associated conducting wire; and the second of said end housings including an isolated U-clip termination trough for each associated conducting wire of said conductor, the U-clip of said trough extending forwardly of the line of each associated conducting wire; and means for securing each associated wire of said conductors to the associated blade and U-clip; and the housing for the blade termination including a cover receiving said associated conducting wires in a side-by-side relation whereby the wires are covered on the top and lateral sides of said housing and open on the underside thereof exposing the blades; and said housing for the blade termination having disposed laterally under the base of the blade troughs adjacent the associated conducting wires a lateral fin and slot; and said housing for the U-clip termination including a cover receiving said associated wires in a side-by-side relation where by the wires are covered on the underside and lateral sides of the housing and open on the top side thereof exposing the U-clips; and said housing for the U-clip termination having disposed laterally under the extent of the U-clips a lateral fin and slot;

whereby the respective housings are connected by engaging the respective fins and slots of the housings while the housings are held in about a perpendicular relation and rotating the connectors to an in-line relation, thereby causing the blades of the respective wire terminations to synchronously engage the respective U-clips of the associated wires.

2. An electrical connector according to claim 1 wherein the housing is constructed of a non-electrically conductive material.

3. The electrical connector of claim 1, wherein the receiving span of the U-clip conductor is complimentary in size to the width of the blade and flexes to receive and retain the blade connector.

4. An electrical connector according to claim 1, in combination with detent means comprising a raised formation on said blade portion for holding engagement with detent means of a mating portion in the U-clip.

5. An electrical connector according to claim 1, wherein a plurality of complimentary conductors are utilized to transmit data.

* * * * *

UNITED STATES PATENT AND TRADEMARK OFFICE

CERTIFICATE OF CORRECTION

PATENT NO. : 7,963,790 B1
APPLICATION NO. : 12/579508
DATED : June 21, 2011
INVENTOR(S) : John R. Winter, Jr.

It is certified that error appears in the above-identified patent and that said Letters Patent is hereby corrected as shown below:

Title Page; item (76);
Inventor's name is corrected to read: JOHN R. WINTER, JR.

Signed and Sealed this
Ninth Day of August, 2011

David J. Kappos

David J. Kappos
*Director of the United States Patent and Trademark Office*